United States Patent [19]

Kaminskas

[11] Patent Number: 4,565,745

[45] Date of Patent: Jan. 21, 1986

[54] METALLIC STRETCH FABRIC

[75] Inventor: Rimvydas A. Kaminskas, Palos Verdes Estates, Calif.

[73] Assignee: TRW Inc., Redondo Beach, Calif.

[21] Appl. No.: 649,109

[22] Filed: Sep. 10, 1984

[51] Int. Cl.[4] ..... H01Q 15/14

[52] U.S. Cl. ..... 428/596; 343/912

[58] Field of Search ..... 343/912, 909, 756, 897, 343/700 MS; 430/318, 323; 52/660, 663; 428/596, 606; D14/86

[56] References Cited

U.S. PATENT DOCUMENTS

| | | | |
|---|---|---|---|
| D. 179,951 | 3/1957 | O'Hare et al. | D14/86 |
| 3,148,370 | 9/1964 | Bowman | 343/909 |
| 3,842,421 | 10/1974 | Rootsey et al. | 343/909 |
| 3,907,565 | 9/1975 | Burton et al. | 343/873 |
| 4,160,254 | 7/1979 | Wise | 343/909 |
| 4,198,639 | 4/1980 | Killion | 343/872 |
| 4,272,770 | 6/1981 | Miller et al. | 343/909 |
| 4,362,595 | 12/1982 | Skog | 430/318 |
| 4,388,388 | 6/1983 | Kornbau et al. | 343/909 |
| 4,479,128 | 10/1984 | Brunner et al. | 343/909 |

FOREIGN PATENT DOCUMENTS

| | | | |
|---|---|---|---|
| 553133 | 12/1956 | Belgium | 52/673 |
| 227604 | 1/1925 | United Kingdom | 343/897 |
| 439608 | 12/1935 | United Kingdom | 343/912 |

*Primary Examiner*—L. Dewayne Rutledge
*Assistant Examiner*—John J. Zimmerman
*Attorney, Agent, or Firm*—Noel F. Heal; James W. Paul

[57] ABSTRACT

A metallic mesh, and a method for its manufacture, for use in making antenna dishes to operate in space at frequencies above 10 GHz. The mesh is formed by making a mesh pattern, photolithographically transferring the pattern onto a sheet of photo-resist coated metal foil, exposing the photo-resist, and then etching the foil. The strands of the mesh have a periodically repeating curved shape to provide a low spring constant resistant to the effects of large temperature changes.

4 Claims, 1 Drawing Figure

METALLIC STRETCH FABRIC

BACKGROUND OF THE INVENTION

1. Field of the Invention

This invention relates generally to the field of radio communications, and more particularly to the field of antenna structures suitable for use at frequencies above 10 gigahertz (GHz).

The steadily increasing volume of radio communications being relayed via satellite has led to worsening frequency congestion. As a result, it has become necessary to utilize frequencies above 10 GHz in order to accommodate this increasing volume of radio traffic. Hence there is a need for antennae suitable for use in space at frequencies above 10 GHz.

In addition, atmospheric attenuation limits the maximum frequencies that can be utilized by surface-based radio astronomy stations to about 50 GHz. In order to avoid this limit, there is a developing interest in conducting radio astronomy operations from space rather than from the surface of the earth. To meet this need, antennae adapted for use in space at these frequencies are required.

An antenna for use at frequencies above 10 GHz generally includes a reflective dish for focusing received energy at a focal point; a receiving element for receiving the energy at the focal point; and a cable, waveguide, or other conducting means for carrying the received energy from the antenna to an amplifier or other device.

A reflective antenna dish, in order to be suitable for use in space, must satisfy numerous special constraints. Among these constraints are: (1) the dish must be light in weight; (2) it must be possible to fold the dish prior to launching from earth and then unfold it after deploying it in space; and (3) the dish must have good radio-frequency (rf) reflectivity at the desired frequency of operation.

In addition to satisfying these constraints, the dish should also be relatively impervious to large temperature changes. A satellite in the earth's shadow can cool to a temperature as low as −230 degrees Celsius; when in direct sunlight, its temperature can rise to +260 degrees Celsius. Unless the dish can resist the effects of such wide temperature swings, it will expand and contract so much that it will warp out of shape and put unacceptable stress on its supporting structure.

The Prior Art

A dish made of solid metal generally cannot satisfy the constraints applicable to the space environment. Therefore, dishes have been fabricated from various kinds of metallic mesh. One such mesh is made of wires that are crinkled to give them a low spring constant, thereby reducing the effects of temperature changes. The wires are laid out in a rectangular grid to form a mesh, and then spot-welded at each point of intersection. However, the higher the frequency, the closer together the wires must be in order to achieve adequate rf reflectivity. Above 10 GHz, the required wire spacing becomes so small (less than 0.1 inches) that the spot-welding method becomes impractical.

Another technique is to weave fine wire into a mesh pattern such as the tricot pattern used for women's stockings. Since there is no welding or similar mechanical attachment of the wires to one another, the space between adjacent wires can be less than 0.1 inches.

However, because of the lack of mechanical attachment, electrical contact among the various wires is established only where the wires touch. Such contacts are subject to being degraded by corrosion. To reduce the corrosion problem, the wires can be gold plated, but then the weight and cost are increased.

It will be apparent from the foregoing that there is a need for an antenna dish that will function at frequencies above 10 GHz while satisfying all the constraints applicable to the space environment. The present invention satisfies this need.

SUMMARY OF THE INVENTION

This invention provides a metallic mesh for use in constructing an antenna dish for operation in space at frequencies above 10 GHz, and a method of fabricating the mesh. In accordance with the invention, the mesh is formed all in one piece from a sheet of metal foil.

Briefly, the method of fabricating the mesh comprises the following steps: first, making a mesh pattern; second, photolithographically exposing the pattern onto a sheet of metal foil coated with a photo-resist material; third, developing the photo-resist; and fourth, etching the foil to remove the part of the foil corresponding to the spaces in the pattern. The result of this process is a one-piece metallic mesh.

The mesh can be made as finely-spaced and as mechanically compliant as desired by selecting foil of an appropriate thickness and by varying the design of the pattern.

A suitable pattern has two sets of intersecting lines, although it could have more than two sets. A pattern of two sets of intersecting lines, each line being in the shape of a periodically repeating curve, has especially good resistance to the effects of wide swings in temperature. The two sets of lines usually are approximately orthogonal to one another. Good results have been obtained by the use of curves of the approximate shape of a sinusoid, but curves of other shapes could be used instead.

One presently preferred embodiment of the invention uses a pattern of two sets of lines, the first set being approximately orthogonal to the second set. The curves are shaped like sinusoids, and the points of intersection along each curved line are spaced such that the curve describes one complete sinusoidal cycle between adjacent intersections. Each intersection is located at a point approximately half way between the maximum and minimum excursions of the cycle.

It will be appreciated from the foregoing that the present invention represents a significant advance in the field of mesh materials for use in fabricating antenna dishes for a space environment. In particular, a dish made of such a mesh is not significantly affected by the extremes of temperature encountered in space, and yet it meets all the other criteria for satisfactory performance in the space environment. Other aspects and advantages of the present invention will become apparent from the following more detailed description taken in conjunction with the accompanying drawings.

DESCRIPTION OF THE PREFERRED EMBODIMENT

Figure 1:
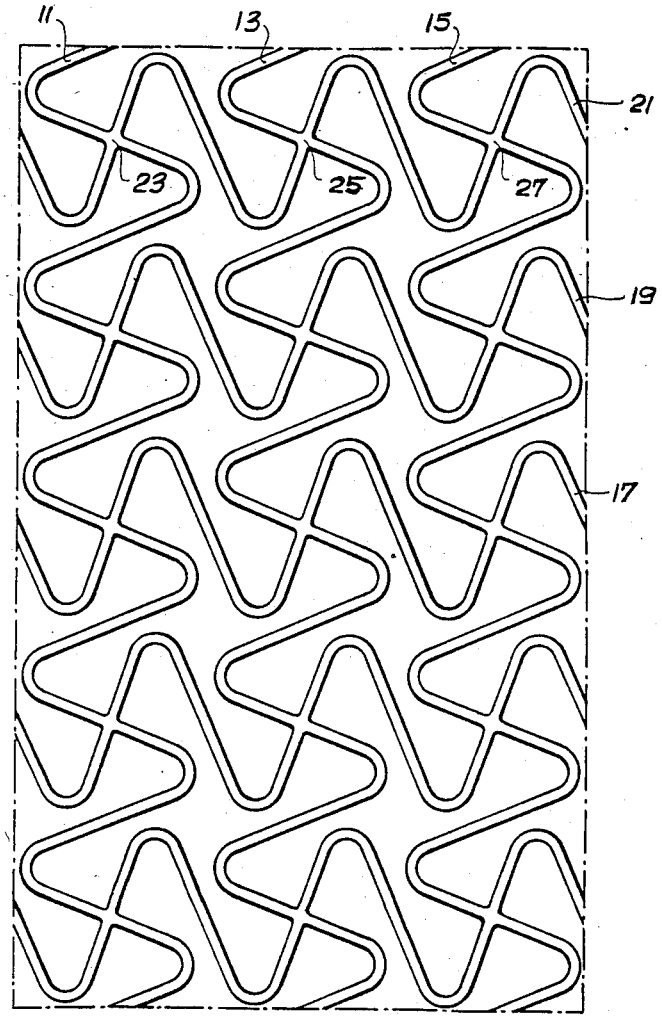
FIG. 1 is a fragmentary plan view of a mesh produced by the method of the invention.

Metallic mesh materials for fabricating antenna dishes for use in space have either not had adequate rf reflectivity for frequencies above 10 GHz, or have not had the required light weight and relative insensitivity to wide swings of temperature. In accordance with the present invention, a mesh having the required physical and electrical characteristics for operation in space at these frequencies, and a method of fabricating such a mesh from a single sheet of metal foil, are provided.

The first step in producing the mesh of the invention is to make an appropriate pattern. A mesh formed according to the pattern illustrated in FIG. 1 has excellent mechanical characteristics in that it is almost unaffected by extremes of temperature, and has the light weight and ability to fold and unfold needed for deployment in space.

In FIG. 1, lines 11, 13 and 15 form a first set of lines, each line in the set being parallel to every other line in the set. The lines 11, 13 and 15 follow identically shaped curves, each of which varies cyclicly about a straight-line axis. Lines 17, 19 and 21 form a second set of similarly curved lines, each line being parallel to the others in the set, in the sense that the straight-line axes of the first set are orthogonal to the axes of the second set. The first set of lines is orthogonal to the second set. Each line in the first set intersects each line in the second set. The curves in each line are approximately sinusoidal in shape and repeat at periodic cycles. For example, the curve of line 21 has one periodic cycle between intersections 27 and 25, and a second periodic cycle between intersections 25 and 23. Intersections 27, 25 and 23 preferably include curved edges rather than sharp corners at the points intersection of line edges.

Many variations of the pattern illustrated in FIG. 1 are possible. The curves, for example, could be patterned in shapes other than the sinusoid depicted. In addition, the two sets of intersecting lines need not be orthogonal to each other. An alternate embodiment could have more than two sets of intersecting lines; for example, a pattern could have three sets of lines, the lines of each set intersecting the lines of the other two to form spaces having three curved sides, rather than the four curved sides of each space as shown in FIG. 1.

The second step in producing the mesh is to photolithographically transfer the pattern to a sheet of metal foil coated with a photo-resist material. This photolithographic process will in the usual case also include photo-reducing, or scaling, the mesh pattern down to the desired final size. At the conclusion of this step, all of the lines and tracings of the pattern will have been superimposed on the photo-resist material.

The third step is to develop the photo-resist. During this step, the photo-resist material is developed and then all of the photo-resist, except that portion having the lines and tracings of the pattern superimposed upon it, is removed from the foil. At the conclusion of this step that portion of the foil corresponding to the spaces in and around the lines and tracings of the pattern is bare of photo-resist material.

The fourth and last step is to etch the metal foil. During the etching, that portion of the foil corresponding to the lines and tracings of the mesh is protected by its covering of photo-resist material. All the rest of the foil is etched away, leaving the finished mesh intact. Removal of the remaining photo-resist completes the process.

The method as described is used to produce a single panel of mesh material. Alternatively, the method can be modified to produce a continuous sheet of mesh material.

The mesh fabricated by this process is light in weight, and folds and unfolds easily. By virtue of the curves in the pattern, the mesh has a very low spring constant and hence is not significantly affected by extreme excursions of temperature. Because the mesh is formed from a single piece of metal, it contains no electrical connections to corrode or fail. In short, the mesh satisfies all the criteria for use in space at frequencies above 10 GHz.

Although one specific embodiment of the method of fabricating metallic mesh, and one specific mesh fabricated by this method, have been described and illustrated, it is to be understood that the invention is not to be limited to the specific forms or steps or arrangements of parts so described and illustrated, and that various changes can be made within the scope of this invention. For example, although disclosed in the context of an antenna dish for deployment in space, the physical characteristics of the mesh make it well suited for other uses in space, such as electromagnetic shielding, or for use on earth in applications requiring a tightly-woven elastic metallic mesh, such as stretch fabrics or protective clothing. It is therefore to be understood that, within the scope of the appended claims, the invention may be practiced otherwise than as specifically described.

I claim:

1. A metallic mesh for use as the dish material of a radio-frequency dish antenna, formed as a single piece of metal and shaped in a pattern having a first set of a plurality of parallel lines, each line in the set being formed in the shape of a periodically repeating curve, and a second set of a plurality of parallel lines intersecting the first set, each line in the additional set being formed in the shape of a periodically repeating curve, the second set of lines being substantially orthogonal in direction with respect to said first set of lines; and wherein the periodically repeating curve is approximately sinusoidal in shape.

2. A metallic mesh for use as the dish material of a radio-frequency dish antenna, formed as a single piece of metal and shaped in a pattern having a first set of a plurality of parallel lines, each line in the set being formed in the shape of a periodically repeating curve, and a second set of a plurality of parallel lines intersecting the first set, each line in the additional set being formed in the shape of a periodically repeating curve, the second set of lines being substantially orthogonal in direction with respect to said first set of lines; and wherein each point of intersection between a line of the first set and a line of the second set occurs approximately at a point on the curve of each intersecting line lying halfway between the maximum and minimum periodic excursions of that curve.

3. A metallic mesh for use as the dish material of a radio-frequency dish antenna, formed as a single piece of metal and shaped in a pattern having a first set of a plurality of strands, each strand being in the shape of a periodically repeating curve, and a second set of a plurality of strands, each strand being in the shape of a periodically repeating curve, the strands in the first set forming a grid by intersecting the strands in the second set, successive strands of the first set intersecting the strands of the second set of successive periodic intervals along the curve shape described by the strands of the second set such that one complete periodic cycle is described by the curve of each strand of each set in between successive intersections with the other set; and wherein the periodically repeating curve is approximately sinusoidal in shape.

4. A metallic mesh for use as the dish material of a radio-frequency dish antenna, formed as a single piece of metal and shaped in a pattern having a first set of a plurality of strands, each strand being in the shape of a periodically repeating curve, and a second set of a plurality of strands, each strand being in the shape of a periodically repeating curve, the strands in the first set forming a grid by intersecting the strands in the second set, successive strands of the first set intersecting the strands of the second set at successive periodic intervals along the curve shape described by the strands of the second set such that one complete periodic cycle is described by the curve of each strand of each set in between successive intersections with the other set; and wherein each point of intersection between a strand of the first set and a strand of the second set occurs approximately at a point on the curve of each intersecting strand lying halfway between the maximum and minimum periodic excursions of that curve.

* * * * *